US011525586B2

(12) United States Patent
Jung et al.

(10) Patent No.: US 11,525,586 B2
(45) Date of Patent: Dec. 13, 2022

(54) TURBO FAN AND AIR-CONDITIONER HAVING THE SAME

(71) Applicant: LG Electronics Inc., Seoul (KR)

(72) Inventors: Jaehyuk Jung, Seoul (KR); Changhoon Lee, Seoul (KR); Seokho Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 200 days.

(21) Appl. No.: 16/706,499

(22) Filed: Dec. 6, 2019

(65) Prior Publication Data

US 2020/0182488 A1 Jun. 11, 2020

(30) Foreign Application Priority Data

Dec. 6, 2018 (KR) ..... 10-2018-0155788

(51) Int. Cl.
*F24F 1/0033* (2019.01)
*F24F 1/0029* (2019.01)
*F24F 1/027* (2019.01)

(52) U.S. Cl.
CPC ..... *F24F 1/0033* (2013.01); *F24F 1/0029* (2013.01); *F24F 1/027* (2013.01)

(58) Field of Classification Search
CPC ..... F04D 29/681; F04D 29/384; F04D 29/30; F04D 29/666; F05D 2240/307; F05D 2240/306; F05D 2240/304; F05D 2240/303; F24F 1/027; F24F 1/0029; F24F 1/0033
See application file for complete search history.

(56) References Cited

U.S. PATENT DOCUMENTS

2012/0207606 A1* 8/2012 Stephan ..... F04D 29/384 416/204 R

FOREIGN PATENT DOCUMENTS

| | | | |
|---|---|---|---|
| CN | 104879253 | | 9/2015 |
| JP | H11247795 A | * | 9/1999 |
| KR | 20070077366 A | * | 7/2007 |
| KR | 20090025626 | | 3/2009 |
| KR | 20170010550 | | 2/2017 |

OTHER PUBLICATIONS

JPH11247795A Translation (Year: 1999).*
KR-20070077366-A Translation (Year: 2007).*
Office Action in Korean Appln. No. 10-2018-0015778, dated Jul. 28, 2022, 4 pages (with English translation).

* cited by examiner

*Primary Examiner* — Schyler S Sanks
(74) *Attorney, Agent, or Firm* — Fish & Richardson P.C.

(57) ABSTRACT

A turbo fan includes a hub for coupling a rotating shaft of a motor, a shroud, and a plurality of blades. Each blade includes an inner insertion portion disposed between the hub and the shroud, and an outer extension portion extending from the inner insertion portion and protruding beyond an outer circumference of the hub. Each blade has a positive pressure surface that includes a front surface facing toward a rotational direction and has a convex shape, and a negative pressure surface that includes a rear surface facing toward an opposite direction to the rotational direction and has a concave shape. Each blade further includes a first flow guide protrusion protruding from the positive pressure surface and arranged at an outer end of the outer extension portion, and extends from one side to the other side of the outer end of the outer extension portion in an axial direction.

18 Claims, 8 Drawing Sheets

TURBO FAN AND AIR-CONDITIONER HAVING THE SAME

CROSS-REFERENCE TO RELATED APPLICATION(S)

The present application claims the benefit of priority to Korean Patent Application No. 10-2018-0155788, filed on Dec. 6, 2018, which is herein incorporated by reference in its entirety.

TECHNICAL FIELD

The present disclosure relates to a turbo fan and an air conditioner having the same.

BACKGROUND

An air conditioner is an apparatus for conditioning indoor air to be comfortable by using a refrigeration cycle that is performed by a compressor, an outdoor heat exchanger, an expansion mechanism, and an indoor heat exchanger.

Some air conditioners may be configured to provide only one of a cooling operation and a heating operation. Other air conditioners may be configured to selectively run heating and cooling operations.

Air conditioners configured to provide both heating and cooling may include a flow path switching valve for switching the flow of the refrigerant passed through the compressor into one of the outdoor heat exchanger and the indoor heat exchanger. Further, in the cooling operation, the outdoor heat exchanger of an air conditioner may serve as a condenser, and the indoor heat exchanger of the air conditioner may serve as an evaporator. In the heating operation, the indoor heat exchanger of an air conditioner may serve as a condenser, and the outdoor heat exchanger of the air conditioner may serve as an evaporator.

Air conditioners may be classified into a stand type air conditioner, a wall-mounted air conditioner, and a window type air conditioner according to the installation position. The stand type air conditioner may include an indoor unit and an outdoor unit that is separated from the indoor unit, while the indoor unit is installed on the floor of room. The wall-mounted air conditioner may include an indoor unit and an outdoor unit that is separated from the indoor unit, while the indoor unit is installed on a side wall of room. The window type air conditioner may include an indoor unit and an outdoor unit that is integrated with the indoor unit, while the indoor unit side is installed indoors, and the outdoor unit side is installed outdoors.

In some window type air conditioners, an outdoor fan may be installed in an outdoor heat exchanger side, and an indoor fan may be installed in an indoor heat exchanger side. In some window type air conditioners, both the outdoor fan and the indoor fan may include an axial flow fan. The axial flow fan may be configured to suction air in the axial direction and then discharge the suctioned air in the axial direction. However, an amount of air discharged by the axial flow fan may be small, and in order to compensate for such a small amount of discharged air, some window type air conditioners may have an outdoor fan configured as an axial flow fan and the indoor fan configured as a turbo fan. While a turbo fan can increase the amount of discharged air in comparison with an axial flow fan, the turbo fan may generate more noise than the axial flow fan.

SUMMARY

The present disclosure describes a turbo fan that can maximize the amount of air and reduce noise, and an air conditioner including the same.

According to one aspect of the subject matter, a turbo fan includes a hub, a shroud, and a plurality of blades. The hub may have a center configured to couple to a rotating shaft of a motor. The shroud may be disposed to be spaced apart from the hub in an axial direction of the turbo fan and include an air suction port arranged in a center of the shroud. The shroud may have an outer diameter that is larger than a diameter of the hub. The plurality of blades may be disposed to be spaced apart from each other along a circumferential direction of the turbo fan. Each of the plurality of blades may have a curved rectangular plate shape. Each blade may include an inner insertion portion, an outer extension portion, a positive pressure surface, a negative pressure surface, and a first flow guide protrusion. The inner insertion portion may be disposed between the hub and the shroud. The outer extension portion may extend from the inner insertion portion and protrude beyond an outer circumference of the hub. The positive pressure surface may include a front surface facing toward a rotational direction and have a convex shape. The negative pressure surface may include a rear surface facing toward a direction opposite to the rotational direction and have a concave shape. The first flow guide protrusion may protrude from the positive pressure surface and be disposed at an outer end of the outer extension portion. The first flow guide protrusion may extend from one side to the other side of the outer end of the outer extension portion in the axial direction.

Implementations according to this aspect may include one or more of the following features. For example, the first flow guide protrusion may include a first inclined surface extending from the positive pressure surface to a first point toward the outer end of the outer extension portion, and extending further away from the positive pressure surface as it becomes closer to the outer end of the outer extension portion. The first flow guide protrusion may include a round surface extending from the first point to a second point toward the outer end of the outer extension portion, and shaped to be convex. The first flow guide protrusion may include a second inclined surface extending from the second point to the outer end of the outer extension portion, and extending to be closer to the positive pressure surface as it becomes closer to the outer end of the outer extension portion.

In some implementations, each of the plurality of blades may include a second flow guide protrusion arranged, in a portion corresponding to the air suction port, on the positive pressure surface of the inner insertion portion. The second flow guide protrusion may extend from one side to the other side of the inner insertion portion in the axial direction. In some implementations, the second flow guide protrusion may be configured as a convex round surface. In some implementations, the second flow guide protrusion may be arranged in a portion spaced from an inner end of the inner insertion portion in a longitudinal direction of the blade. In some implementations, the second flow guide protrusion may include a plurality of second flow guide protrusions being spaced apart from each other along a longitudinal direction of the blade. In some implementations, the plurality of second flow guide protrusions may be spaced apart from each other at a same interval along the longitudinal direction of the blade. In some implementations, the plurality of second flow guide protrusions may include an outer flow guide protrusion arranged outwards in the longitudinal direction of the blade, an inner flow guide protrusion arranged inwards in the longitudinal direction of the blade, and a middle flow guide protrusion arranged between the outer flow guide protrusion and the inner flow guide protrusion. In some implementations, the middle flow guide protrusion may include a plurality of middle flow guide protrusions. In some implementations, the plurality of middle flow guide protrusions may include a first middle flow guide protrusion and a second middle flow guide protrusion.

In some implementations, each of the plurality of blades may include an edge inclined surface included in the positive pressure surface of the inner insertion portion, and arranged, in a portion corresponding to the air suction port, along one side of the inner insertion portion close to the shroud.

In some implementations, each of the plurality of blades may be arranged in parallel with the rotating shaft in the axial direction.

In some implementations, the diameter of the hub may be smaller than a diameter of the air suction port.

In some implementations, the outer end of the outer extension portion may be disposed inside an outer circumference of the shroud.

According to another aspect of the subject matter, an air conditioner may include an outdoor heat exchanger, an indoor heat exchanger spaced apart from the outdoor heat exchanger in an axial direction, an axial flow fan disposed at a side of the outdoor heat exchanger and between the outdoor heat exchanger and the indoor heat exchanger, and a turbo fan disposed at a side of the indoor heat exchanger and between the outdoor heat exchanger and the indoor heat exchanger. The turbo fan may include a hub, a shroud, and a plurality of blades. The hub may have a center configured to couple to a rotating shaft of a motor. The shroud may be disposed to be spaced apart from the hub in the axial direction and include an air suction port arranged in a center of the shroud. The shroud may have an outer diameter that is larger than a diameter of the hub. The plurality of blades may be disposed to be spaced apart from each other along a circumferential direction. Each of the plurality of blades may have a curved rectangular plate shape. Each blade may include an inner insertion portion, an outer extension portion, a positive pressure surface, a negative pressure surface, and a first flow guide protrusion. The inner insertion portion may be disposed between the hub and the shroud. The outer extension portion may extend from the inner insertion portion and protrude beyond an outer circumference of the hub. The positive pressure surface may include a front surface facing toward a rotational direction and having a convex shape. The negative pressure surface may include a rear surface facing toward a direction opposite to the rotational direction and having a concave shape. The first flow guide protrusion may protrude from the positive pressure surface and be disposed at an outer end of the outer extension portion. The first flow guide protrusion may extend from one side to the other side of the outer end of the outer extension portion in the axial direction.

Implementations according to this aspect may include one or more of the following features. For example, the first flow guide protrusion may include a first inclined surface extending from the positive pressure surface to a first point toward the outer end of the outer extension portion, and extending further away from the positive pressure surface as it becomes closer to the outer end of the outer extension portion. The first flow guide protrusion may include a round surface extending from the first point to a second point toward the outer end of the outer extension portion, and shaped to be convex. The first flow guide protrusion may include a second inclined surface extending from the second point to the outer end of the outer extension portion, and extending to be closer to the positive pressure surface as it becomes closer to the outer end of the outer extension portion.

In some implementations, each of the plurality of blades may include a second flow guide protrusion arranged, in a portion corresponding to the air suction port, on the positive pressure surface of the inner insertion portion, the second flow guide protrusion extending from one side to the other side of the inner insertion portion in the axial direction. In some implementations, the second flow guide protrusion may be configured as a convex round surface. In some implementations, the second flow guide protrusion may be arranged in a portion spaced from an inner end of the inner insertion portion in a longitudinal direction of the blade.

In some implementations, the second flow guide protrusion may include a plurality of second flow guide protrusions being spaced apart from each other along a longitudinal direction of the blade.

In some implementations, each of the plurality of blades may include an edge inclined surface included in the positive pressure surface of the inner insertion portion, and arranged, in a portion corresponding to the air suction port, along one side of the inner insertion portion close to the shroud.

Specific details of other implementations are included in the detailed description and drawings.

DETAILED DESCRIPTION

Exemplary implementations of the present disclosure are described with reference to the accompanying drawings in detail. The same reference numbers are used throughout the drawings to refer to the same or like parts. Detailed descriptions of well-known functions and structures incorporated herein may be omitted to avoid obscuring the subject matter of the present disclosure.

An example turbo fan and an example air conditioner including the turbo fan will be described with reference to the drawings.

Figure 1:
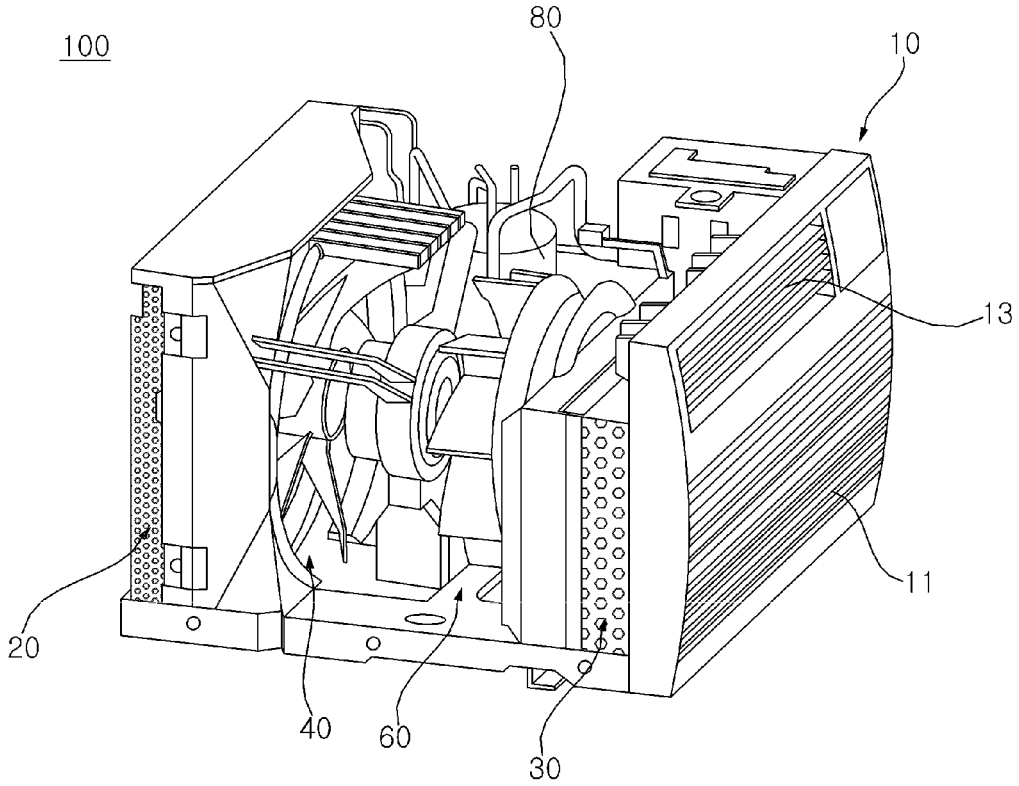
FIG. 1 illustrates an example air conditioner including an example turbo fan.
Figure 2:
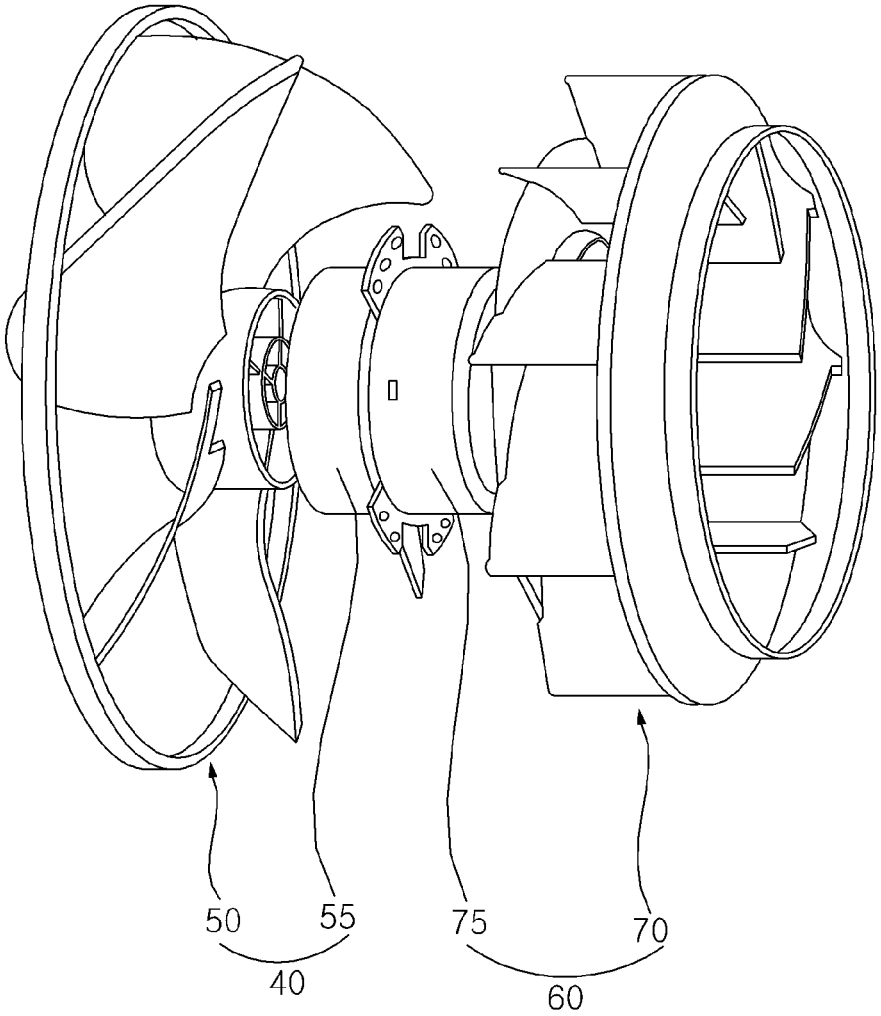
FIG. 2 illustrates examples of an outdoor blower and an indoor blower shown in FIG. 1.

FIG. 1 illustrates an example air conditioner including an example turbo fan, and FIG. 2 illustrates examples of an outdoor blower and an indoor blower shown in FIG. 1. In some implementations, the air conditioner can include an indoor unit and an outdoor unit which are integrally formed, and can be installed in a window of a building.

The air conditioner 100 can include an outdoor heat exchanger 20, an indoor heat exchanger 30 spaced apart from the outdoor heat exchanger 20 in the axial direction, an axial flow fan 50, and a turbo fan 70. The axial flow fan 50 can be disposed between the outdoor heat exchanger 20 and the indoor heat exchanger 30 and at the side of the outdoor heat exchanger 20 (e.g., close to the outdoor heat exchanger 20). The turbo fan 70 can be disposed between the outdoor heat exchanger 20 and the indoor heat exchanger 30 and at the side of the indoor heat exchanger 30 (e.g., close to the indoor heat exchanger 30).

The air conditioner 100 can further include a case 10 forming an outer shape. In some implementations, the case 10 may be shaped as a rectangular hexahedron. The outdoor heat exchanger 20, the indoor heat exchanger 30, an outdoor blower 40, and an indoor blower 60 may be included in the case 10. In addition, a compressor 80 for compressing the refrigerant and an expansion mechanism for expanding the refrigerant may be housed in the case 10.

The compressor 80, the outdoor heat exchanger 20, the expansion mechanism, and the indoor heat exchanger 30 can be connected through a plurality of refrigerant pipes.

In some implementations, the air conditioner 100 can be configured to perform cooling operation only. In alternative implementations, the air conditioner 100 can be configured to perform heating operation only. In yet alternative implementations, the air conditioner 100 can be configured to selectively perform cooling operation and heating operation.

In implementations where the air conditioner 100 is configured to selectively perform cooling operation and heating operation, the air conditioner 100 can further include a cooling and heating switching valve for switching the flow of compressed refrigerant discharged from the compressor 80 to one of the outdoor heat exchanger 20 and the indoor heat exchanger 30. For example, when the air conditioner 100 is in the cooling operation, the cooling and heating switching valve can allow the compressed refrigerant discharged from the compressor 80 to flow to the outdoor heat exchanger 20. In the cooling operation, the outdoor heat exchanger 20 serves as a condenser for condensing the refrigerant, and the indoor heat exchanger 30 serves as an evaporator for evaporating the refrigerant. In the cooling operation, the refrigerant may be circulated through the compressor 80, the outdoor heat exchanger 20, the expansion mechanism, and the indoor heat exchanger 30 in this order.

When the air conditioner 100 is in the heating operation, the cooling and heating switching valve can allow the compressed refrigerant discharged from the compressor 80 to flow to the indoor heat exchanger 30. In the heating operation, the outdoor heat exchanger 20 serves as an evaporator to evaporate the refrigerant, and the indoor heat exchanger 30 serves as a condenser to condense the refrigerant. In the heating operation, the refrigerant can be circulated through the compressor 80, the indoor heat exchanger 30, the expansion mechanism, and the outdoor heat exchanger 20 in this order.

An indoor air suction port 11 and an indoor air discharge port 13 can be provided in the indoor side of the case 10. In some implementations, the indoor air suction port 11 can be disposed below the indoor air discharge port 13.

When the turbo fan 70 is rotated, indoor air can flow into the case 10 through the indoor air suction port 11 and heat exchanges with the indoor heat exchanger 30. The air can then pass through the turbo fan 70 and be discharged to the room through the indoor air discharge port 13.

An outdoor air discharge port can be provided in the outdoor side of the case 10. In some implementations, the outdoor side surface of the case 10 can include a surface opposite to the indoor side surface of the case 10. In some implementations, an outdoor air suction port may be provided in upper and side surfaces of the outdoor portion of the case 10.

When the axial flow fan 50 is rotated, outdoor air can flow into the case 10 through the outdoor air suction port, and pass through the axial flow fan 50. The air can then heat exchange with the outdoor heat exchanger 20 and be discharged to the outside through the outdoor air discharge port.

Referring to FIG. 2, the outdoor blower 40 can include the axial flow fan 50 and an outdoor motor 55 having a rotating shaft. In some implementations, the rotating shaft of the outdoor motor 55 can be coupled to a center of the axial flow fan 50. The axial flow fan 50 can suction air in the axial direction thereof and then discharge the air in the axial direction thereof.

The indoor blower 60 can include the turbo fan 70 and an indoor motor 75 having a rotating shaft. In some implementations, the rotating shaft of the indoor motor 75 can be coupled to a center of the turbo fan 70. The turbo fan 70 can suction air in the axial direction thereof and then discharge the air in the circumferential direction thereof.

In some implementations, the rotating shaft of the outdoor motor 55 and the rotating shaft of the indoor motor 75 may be disposed coaxially.

In some implementations, the case 10 may include several pieces of panels. For example, the case 10 may include a partition plate on which the outdoor motor 55 and the indoor motor 75 are installed. The partition plate may divide an inner space of the case 10 into a first space and a second space. The first space may include a space in which the outdoor heat exchanger 20 and the outdoor blower 40 are installed, and the second space may include a space in which the indoor heat exchanger 30 and the indoor blower 60 are installed. The first space and the second space may be separate from each other.

The turbo fan 70 can increase the amount of air flow, in comparison with the axial flow fan 50. Therefore, in implementations where the indoor blower 60 includes the turbo fan 70, the air conditioner can increase the amount of air flow, in comparison with other implementations where the indoor blower 60 uses the axial flow fan 50. However, the turbo fan 70 may generate more noise than the axial flow fan 50. Therefore, the air conditioner with the indoor blower 60 having the turbo fan 70 can generate more noise while the amount of air flow can be increased in comparison with other implementations where the indoor blower 60 uses the axial flow fan 50.

The structure of the turbo fan 70 for maximizing the air amount of the turbo fan 70 and reducing noise will be described in detail below. The indoor motor 75 is also referred to as a motor 75 herein.

Figure 3:
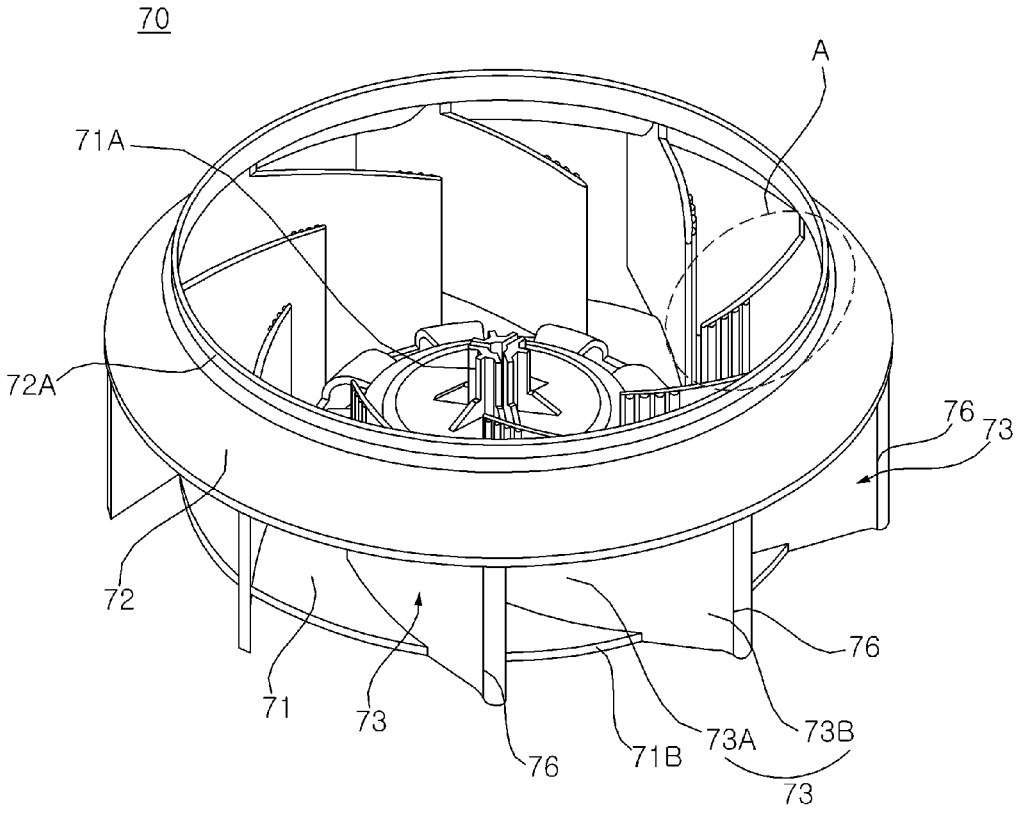
FIG. 3 illustrates an example of a turbo fan shown in FIG. 2.
Figure 4:
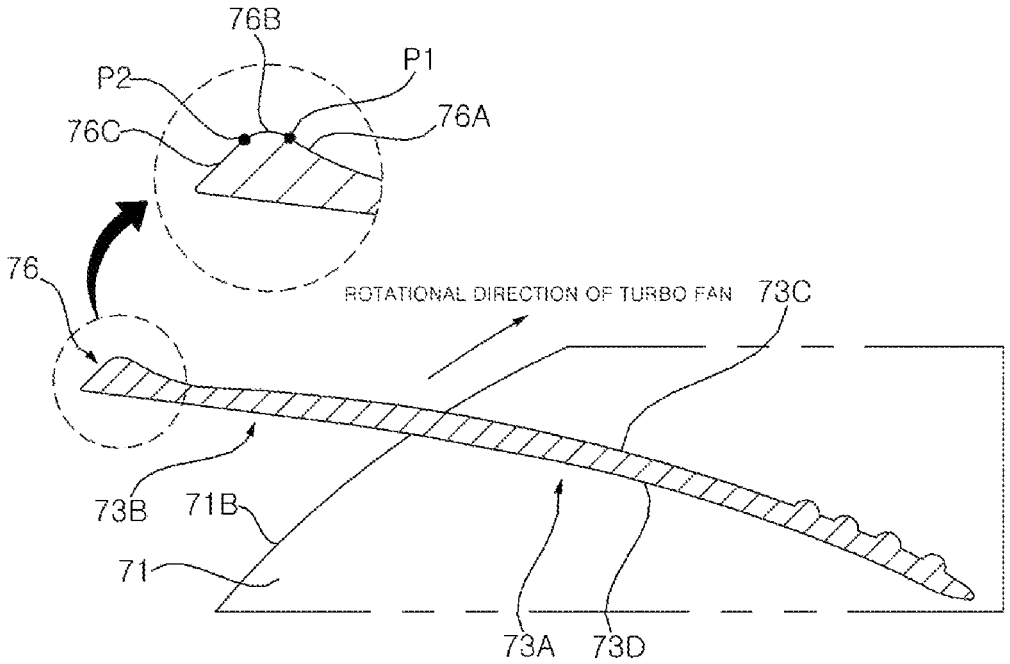
FIG. 4 is a cross-sectional view of an example of a blade shown in FIG. 3.

FIG. 3 illustrates the turbo fan shown in FIG. 2, and FIG. 4 is a horizontal cross-sectional view of a blade shown in FIG. 3. In some implementations, the turbo fan 70 can include a hub 71, a shroud 72, and a plurality of blades 73.

The rotating shaft of the motor 75 can be coupled to the center of the hub 71. In some implementations, the hub 71 can be formed in a disc shape. The turbo fan 70 can include a shaft coupling portion 71A that protrudes from an inner center of the hub 71 and is configured to couple the rotating shaft of the motor 75. The shaft coupling portion 71A can be configured to extend in the axial direction. In some implementations, an outer side of the shaft coupling portion 71A can have a shaft insertion groove extended inwardly. The rotating shaft of the motor 75 can be inserted into the shaft coupling portion 71A through the shaft insertion groove outside the hub 71, and coupled with the shaft coupling portion 71A so that the rotating shaft of the motor 75 can be coupled to the center of the hub 71. The motor 75 may be disposed outside the hub 71.

In some implementations, a central portion of the hub 71 can have a convex inner side and a concave outer side. In this configuration, the motor 75 can be inserted into the concave outer side of the central portion of the hub 71.

The shroud 72 can be disposed to be axially spaced apart from the hub 71. The shroud 72 can be disposed to face the hub 71. An air suction port 72A can be provided in a center of the shroud 72. In some implementations, the shroud 72 can be formed in a circular shape, and the air suction port 72A can be formed in a circular shape. Air suctioned through the air suction port 72A can be discharged through a space between the hub 71 and the shroud 72.

In some implementations, the diameter of the hub 71 can be smaller than the outer diameter of the shroud 72. The diameter of the hub 71 can be smaller than the diameter of the air suction port 72A. The outer diameter of the shroud 72 can be larger than the diameter of the hub 71.

The plurality of blades 73 can be spaced apart from each other along the circumferential direction of the turbo fan 70. In the illustrated implementations, the plurality of blades 73 includes nine blades. However, the number of blades 73 is not limited to nine.

Each of the plurality of blades 73 can include an inner insertion portion 73A and an outer extension portion 73B. The inner insertion portion 73A can be disposed between the hub 71 and the shroud 72. The outer extension portion 73B can extend from the inner insertion portion 73A and protrude beyond an outer circumference 71B of the hub 71. The inner insertion portion 73A can be disposed inwardly with respect to the outer circumference 71B of the hub 71. The outer extension portion 73B can be disposed outside the outer circumference 71B of the hub 71. In some implementations, the outer end of the outer extension portion 73B can be configured to not protrude beyond the outer circumference of the shroud 72.

Each of the plurality of blades 73 can have a curved rectangular plate shape having a positive pressure surface 73C and a negative pressure surface 73D. The positive pressure surface 73C can include the front surface facing toward the rotational direction, and have a convex shape. The negative pressure surface 73D can include the rear surface facing toward the direction opposite to the rotational direction, and have a concave shape.

In some implementations, each of the plurality of blades 73 can be configured to extend in the axial direction (e.g., from one axial side to the other axial side of the turbo fan 70) and in parallel with the rotating shaft of the motor 75.

In some implementations, each blade 73 can include a first flow guide protrusion 76 protruding from the positive pressure surface 73C and provided at the outer end of the outer extension portion 73B. The first flow guide protrusion 76 can be configured to extend from one axial side to the other axial side of the outer end of the outer extension portion 73B along the axial direction.

In some implementations, the first flow guide protrusion 76 can include a first inclined surface 76A, a round surface 76B, and a second inclined surface 76C. The first inclined surface 76A can extend from the positive pressure surface 73C to a first point P1 toward the outer end of the outer extension portion 73B, and can extend further away from the positive pressure surface 73C as it becomes closer to the outer end of the outer extension portion 73B. The round surface 76B can extend from the first point P1 to a second point P2 toward the outer end of the outer extension portion 73B. The round surface 76B can be formed convexly. The second inclined surface 76C can extend from the second certain point P2 to the outer end of the outer extension portion 73B, and can extend to be closer to the positive pressure surface 73C as it becomes closer to the outer end of the outer extension portion 73B. In some implementations, the length of the first inclined surface 76A can be longer than the length of the second inclined surface 76C. In some implementations, the outer end of the outer extension portion 73B can be configured as an inclined surface by the second inclined surface 76C.

When the turbo fan 70 rotates, a discharge flow angle of the air flowing over the positive pressure surface 73C of the blade 73 can be changed in the rotational direction of the turbo fan 70 by the first flow guide protrusion 76 that protrudes from the positive pressure surface 73C at the outer end of the outer extension portion 73B of the blade 73. Therefore, the first flow guide protrusion 76 can reduce noise while maintaining the amount of air flow from the turbo fan 70, in comparison with implementations where the first flow guide protrusion 76 is not provided at the outer end of the outer extension portion 73B of the blade 73.

Figure 5:
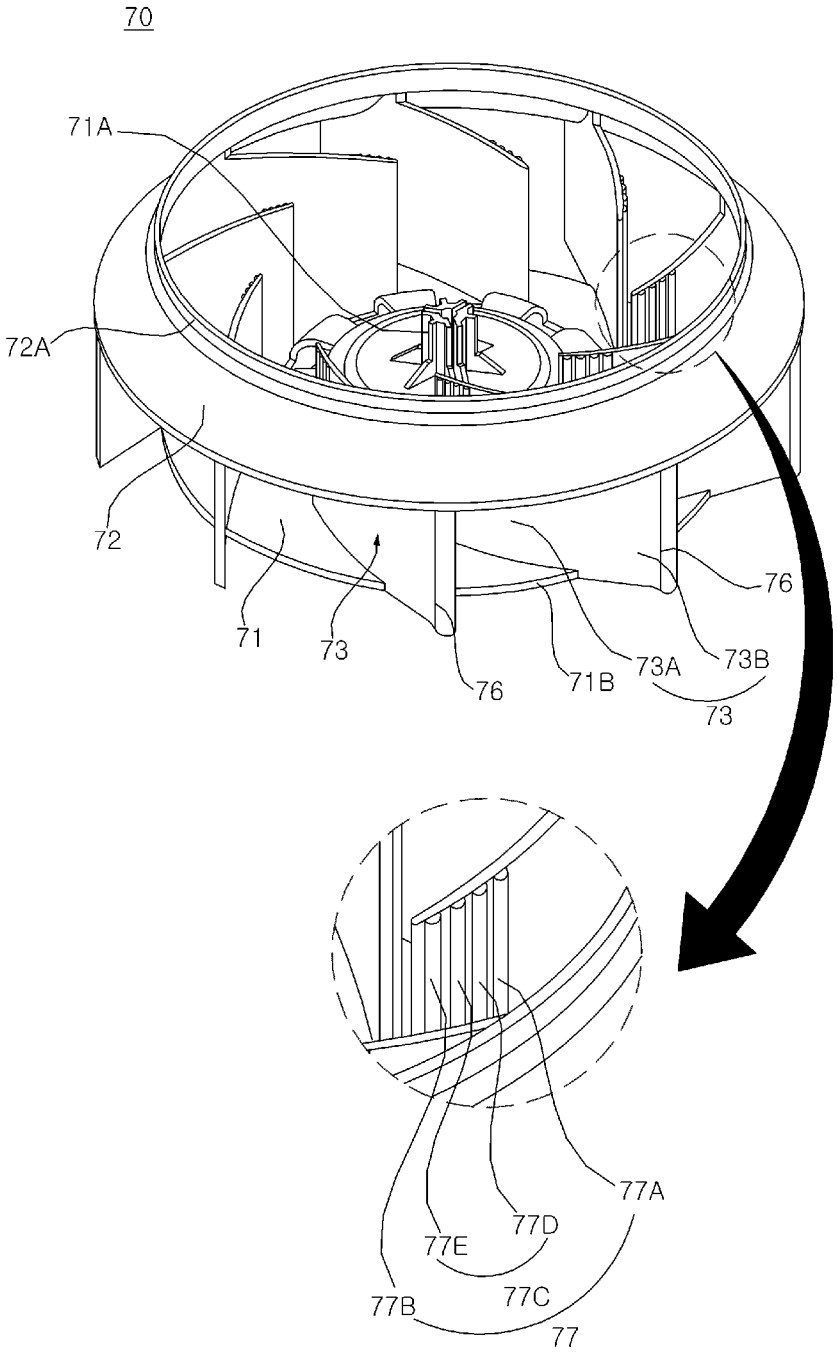
FIG. 5 illustrates an example of a turbo fan shown in FIG. 2.
Figure 6:
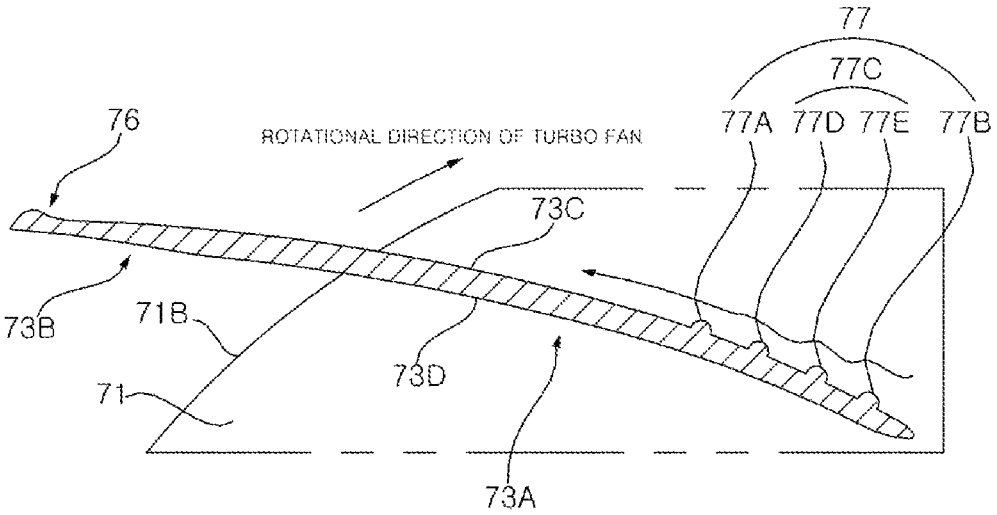
FIG. 6 is a cross-sectional view of an example of a blade shown in FIG. 5.

FIG. 5 illustrates an example of the turbo fan shown in FIG. 2, and FIG. 6 is a horizontal cross-sectional view of the blade shown in FIG. 5. In this example, the turbo fan can include a second flow guide protrusion 77 provided on the positive pressure surface 73C of the inner insertion portion 73A in a portion corresponding to the air suction port 72A. The second flow guide protrusion 77 can be configured to extend from one axial side to the other axial side of the inner insertion portion 73A along the axial direction. In some implementations, the second flow guide protrusion 77 can be configured as a convex round surface. The second flow guide protrusion 77 can be arranged in a portion spaced apart from the inner end of the inner insertion portion 73A in the longitudinal direction of the blade 73.

In some implementations, a plurality of second flow guide protrusions 77 can be provided. The plurality of second flow guide protrusions 77 can be spaced apart from each other along the longitudinal direction of the blade 73. In some implementations, each of the plurality of second flow guide protrusions 77 can be configured as a convex round surface. In some implementations, the plurality of second flow guide protrusions 77 can be spaced apart from each other at same interval along the longitudinal direction of the blade 73.

In some implementations, the plurality of second flow guide protrusions 77 can include an outer flow guide protrusion 77A, an inner flow guide protrusion 77B, and a middle flow guide protrusion 77C. The outer flow guide protrusion 77A can be disposed outwards in the longitudinal direction of the blade 73 (e.g., closer to the outer longitudinal end of the blade, and farther from the inner longitudinal end of the blade). The inner flow guide protrusion 77B can be disposed inwards in the longitudinal direction of the blade 73 (e.g., closer to the inner longitudinal end of the blade, and farther from the outer longitudinal end of the blade). The middle flow guide protrusion 77C can be disposed between the outer flow guide protrusion 77A and the inner flow guide protrusion 77B.

In some implementations, a plurality of middle flow guide protrusions 77C can be provided. For example, the plurality of middle flow guide protrusions 77C can include a first middle flow guide protrusion 77D and a second middle flow guide protrusion 77E. The first middle flow guide protrusion 77D can be disposed outwards in the longitudinal direction of the blade 73 (e.g., closer to the outer longitudinal end of the blade, and farther from the inner longitudinal end of the blade), in comparison with the second middle flow guide protrusion 77E. As illustrated, for example, the first middle flow guide protrusion 77D can be disposed closer to the outer flow guide protrusion 77A between the outer flow guide protrusion 77A and the inner flow guide protrusion 77B. The second middle flow guide protrusion 77E can be disposed closer to the inner flow guide protrusion 77B between the outer flow guide protrusion 77A and the inner flow guide protrusion 77B.

In implementations where the plurality of middle flow guide protrusions 77C includes the first middle flow guide protrusion 77D and the second middle flow guide protrusion 77E, the plurality of second flow guide protrusions 77 can include a total of four second flow guide protrusions including the outer flow guide protrusion 77A, the first middle flow guide protrusion 77D, the second middle flow guide protrusion 77E, and the inner flow guide protrusion 77B. In some implementations, the outer flow guide protrusion 77A, the first middle flow guide protrusion 77D, the second middle flow guide protrusion 77E, and the inner flow guide protrusion 77B can be spaced apart from each other at same interval.

When the turbo fan 70 rotates, the air is initially introduced from the air suction port 72A to the positive pressure surface 73C of the blade 73, thereby generating a turbulent energy. The turbulent energy can be increased by the second flow guide protrusion 77 protruding from the positive pressure surface 73C of the inner insertion portion 73A of the blade 73 in a portion corresponding to the air suction port 72A, thereby preventing flow separation. Therefore, the second flow guide protrusion 77 can reduce noise while maintaining the amount of air flow in the turbo fan 70, in comparison with implementations where the second flow guide protrusion 77 is not provided on the positive pressure surface 73C of the inner insertion portion 73A of the blade 73 in a portion corresponding to the air suction port 72A.

Figure 7:
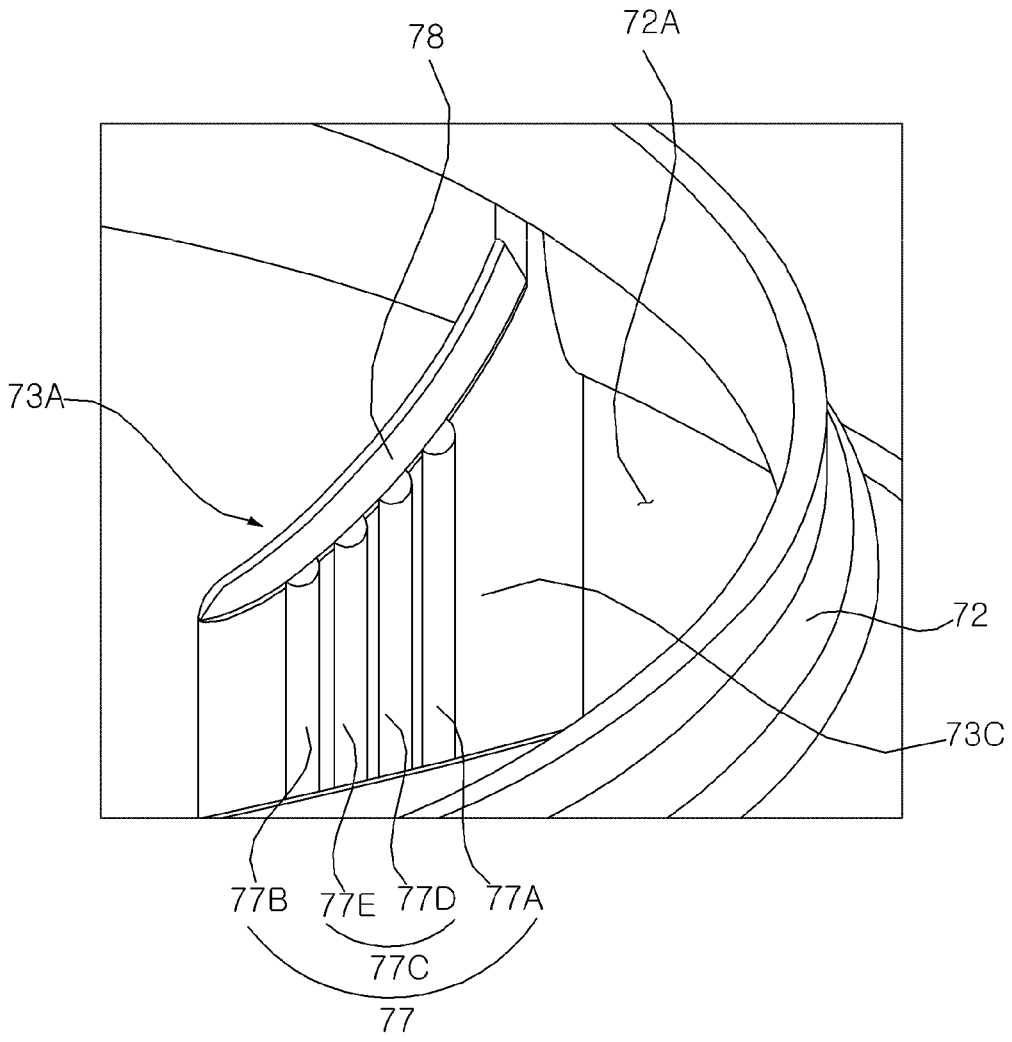
FIG. 7 is an enlarged view of a portion A depicted in FIG. 3.
Figure 8:
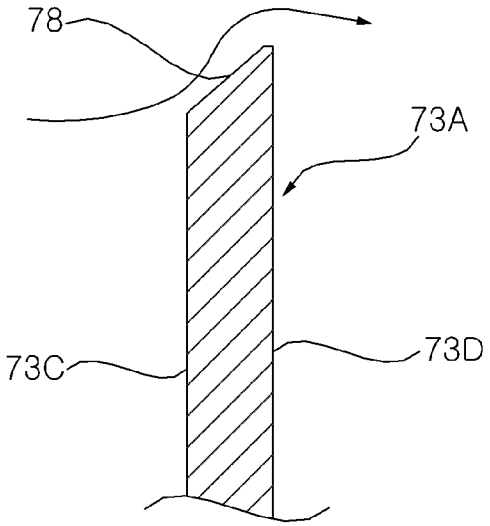
FIG. 8 is a vertical cross-sectional view of the blade shown in FIG. 7.

FIG. 7 is an enlarged view of a portion A depicted by a dotted line in FIG. 3, and FIG. 8 is a vertical cross-sectional view of the blade shown in FIG. 7. As illustrated, the blade can include an edge inclined surface 78 provided on the positive pressure surface 73C of the inner insertion portion 73A. The edge inclined surface 78 can be provided, in a portion corresponding to the air suction port 72A, along one side of the inner insertion portion 73A close to the shroud 72.

When the turbo fan 70 rotates, the air initially introduced from the air suction port 72A to the positive pressure surface 73C of the blade 73 can be smoothly escaped over the edge inclined surface 78. The edge inclined surface 78 can reduce noise while maintaining the amount of air through the turbo fan 70, as vortex is not generated while flowing through the edge inclined surface 78 of the inner insertion portion 73A, in comparison with implementations where the edge inclined surface 78 is not provided in the positive pressure surface 73C of the inner insertion portion 73A of the blade 73.

As described above, the turbo fan 70, and the air conditioner 100 including the turbo fan 70, can include a first flow guide protrusion 76 that protrudes from the positive pressure surface 73C and is provided at the outer end of the outer extension portion 73B of the blade 73. The first flow guide protrusion 76 can be configured to extend from one side to the other side of the outer end of the outer extension portion 73B in the axial direction. Therefore, the turbo fan 70 and the air conditioner 100 including the turbo fan 70 can have the effect of maximizing the air amount and reducing the noise due to the first flow guide protrusion 76.

In addition or alternatively, the turbo fan 70, and the air conditioner 100 including the turbo fan 70, can include a second flow guide protrusion 77 that is provided in a portion corresponding to the air suction port 72A on the positive pressure surface 73C of the inner insertion portion 73A of the blade 73. The second flow guide protrusion 77 can be configured to extend from one side to the other side of the inner insertion portion 73A in the axial direction. Therefore, the turbo fan 70 and the air conditioner 100 including the turbo fan 70 can maximize the air amount and reduce the noise due to the second flow guide protrusion 77.

In addition or alternatively, the turbo fan 70, and the air conditioner 100 including the turbo fan 70, can include an edge inclined surface 78 that is formed on the positive pressure surface 73C of the inner insertion portion 73A. The edge inclined surface 78 can be formed in a portion corresponding to the air suction port 72A among one side of the inner insertion portion 73A close to the shroud 72. Therefore, the turbo fan 70 and the air conditioner 100 including the turbo fan 70 can maximize the air amount and reduce noise due to the edge inclined surface 78.

As described above, in the turbo fan and the air conditioner having the turbo fan according to the present disclosure, a first flow guide protrusion protruding to the positive pressure surface is formed in an outer end of the outer extension portion of the blade, and the first flow guide protrusion is formed to extend from one side to the other side of the outer end of the outer extension portion in its axial direction. Accordingly, the turbo fan and the air conditioner including the turbo fan according to the present disclosure have the effect of maximizing the air volume and reducing the noise due to the first flow guide protrusion.

In addition, in the turbo fan and the air conditioner having the turbo fan according to the present disclosure, a second flow guide protrusion is formed in a portion corresponding to the air suction port on the positive pressure surface of the inner insertion portion of the blade, and the second flow guide protrusion is formed to extend from one side to the other side of the inner insertion portion in the axial direction. Accordingly, the turbo fan and the air conditioner including the turbo fan according to the present disclosure have the effect of maximizing the air volume and reducing the noise due to the second flow guide protrusion.

In addition, in the turbo fan and the air conditioner having the turbo fan according to the present disclosure, an edge inclined surface is formed on the positive pressure surface of the inner insertion portion, and is formed in a portion corresponding to the air suction port among one side of the inner insertion portion close to the shroud. Accordingly, the turbo fan and the air conditioner including the turbo fan according to the present disclosure have the effect of maximizing the air volume and reducing the noise due to the edge inclined surface.

The advantages and technical effects of the present disclosure are not limited to the above-mentioned advantages and technical effects, and other advantages and technical effects that are not mentioned will be clearly understood by those skilled in the art from the description of the claims.

Although the exemplary implementations of the present disclosure have been disclosed for illustrative purposes, those skilled in the art will appreciate that various modifications, additions and substitutions are possible, without departing from the scope and spirit of the subject matter as disclosed in the accompanying claims. Accordingly, the scope of the present disclosure is not construed as being limited to the described implementations but is defined by the appended claims as well as equivalents thereto.

The invention claimed is:

1. A turbo fan comprising:

a hub having a center configured to couple to a rotating shaft of a motor;

a shroud that is disposed to be spaced apart from the hub in an axial direction of the turbo fan and that includes an air suction port arranged in a center of the shroud, the shroud having an outer diameter that is larger than a diameter of the hub; and a plurality of blades disposed to be spaced apart from each other along a circumferential direction of the turbo fan, each of the plurality of blades having a curved rectangular plate shape and including:

an inner insertion portion disposed between the hub and the shroud, an outer extension portion extending from the inner insertion portion and protruding beyond an outer circumference of the hub, a positive pressure surface including a front surface facing toward a rotational direction and having a convex shape, a negative pressure surface including a rear surface facing toward a direction opposite to the rotational direction and having a concave shape, and a first flow guide protrusion protruding from the positive pressure surface and disposed at an outer end of the outer extension portion, the first flow guide protrusion extending from one side to the other side of the outer end of the outer extension portion in the axial direction, wherein the first flow guide protrusion comprises:

a first inclined surface extending from the positive pressure surface to a first point toward the outer end of the outer extension portion, and extending further away from the positive pressure surface as it becomes closer to the outer end of the outer extension portion, the first inclined surface being inclined relative to the positive pressure surface, a round surface extending from the first point to a second point toward the outer end of the outer extension portion, and shaped to be convex, and a second inclined surface extending from the second point to the outer end of the outer extension portion, and extending to be closer to the positive pressure surface as it becomes closer to the outer end of the outer extension portion, the second inclined surface being inclined relative to the positive pressure surface, wherein a first length in which the first inclined surface extends from the positive pressure surface to the first point is longer than a second length in which the second inclined surface extends from the second point to the outer end of the outer extension portion, and wherein the first flow guide protrusion is spaced in the axial direction from the air suction port and positioned outside a periphery of the air suction port.

2. The turbo fan of claim 1, wherein each of the plurality of blades comprises:

a second flow guide protrusion arranged, in a portion corresponding to the air suction port, on the positive pressure surface of the inner insertion portion, the second flow guide protrusion extending from one side to the other side of the inner insertion portion in the axial direction.

3. The turbo fan of claim 2, wherein the second flow guide protrusion is configured as a convex round surface.

4. The turbo fan of claim 2, wherein the second flow guide protrusion is arranged in a portion spaced from an inner end of the inner insertion portion in a longitudinal direction of the blade.

5. The turbo fan of claim 2, wherein the second flow guide protrusion includes a plurality of second flow guide protrusions being spaced apart from each other along a longitudinal direction of the blade.

6. The turbo fan of claim 5, wherein the plurality of second flow guide protrusions are spaced apart from each other at a same interval along the longitudinal direction of the blade.

7. The turbo fan of claim 5, wherein the plurality of second flow guide protrusions comprises:

an outer flow guide protrusion arranged outwards in the longitudinal direction of the blade;

an inner flow guide protrusion arranged inwards in the longitudinal direction of the blade; and a middle flow guide protrusion arranged between the outer flow guide protrusion and the inner flow guide protrusion.

8. The turbo fan of claim 7, wherein the middle flow guide protrusion includes a plurality of middle flow guide protrusions.

9. The turbo fan of claim 8, wherein the plurality of middle flow guide protrusions includes a first middle flow guide protrusion and a second middle flow guide protrusion.

10. The turbo fan of claim 1, wherein each of the plurality of blades comprises:

an edge inclined surface included in the positive pressure surface of the inner insertion portion, and arranged, in a portion corresponding to the air suction port, along one side of the inner insertion portion close to the shroud.

11. The turbo fan of claim 1, wherein each of the plurality of blades is arranged in parallel with the rotating shaft in the axial direction.

12. The turbo fan of claim 1, wherein the diameter of the hub is smaller than a diameter of the air suction port.

13. The turbo fan of claim 1, wherein the outer end of the outer extension portion is disposed inside an outer circumference of the shroud.

14. An air conditioner comprising:

an outdoor heat exchanger;

an indoor heat exchanger spaced apart from the outdoor heat exchanger in an axial direction;

an axial flow fan disposed at a side of the outdoor heat exchanger and between the outdoor heat exchanger and the indoor heat exchanger; and a turbo fan disposed at a side of the indoor heat exchanger and between the outdoor heat exchanger and the indoor heat exchanger, the turbo fan comprising:

a hub having a center configured to couple to a rotating shaft of a motor;

a shroud that is disposed to be spaced apart from the hub in the axial direction and that includes an air suction port arranged in a center of the shroud, the shroud having an outer diameter that is larger than a diameter of the hub; and a plurality of blades disposed to be spaced apart from each other along a circumferential direction, each of the plurality of blades having a curved rectangular plate shape and including:

an inner insertion portion disposed between the hub and the shroud, an outer extension portion extending from the inner insertion portion and protruding beyond an outer circumference of the hub, a positive pressure surface including a front surface facing toward a rotational direction and having a convex shape, a negative pressure surface including a rear surface facing toward a direction opposite to the rotational direction and having a concave shape, and a first flow guide protrusion protruding from the positive pressure surface and disposed at an outer end of the outer extension portion, the first flow guide protrusion extending from one side to the other side of the outer end of the outer extension portion in the axial direction, wherein the first flow guide protrusion comprises:

a first inclined surface extending from the positive pressure surface to a first point toward the outer end of the outer extension portion, and extending further away from the positive pressure surface as it becomes closer to the outer end of the outer extension portion, the first inclined surface being inclined relative to the positive pressure surface, a round surface extending from the first point to a second point toward the outer end of the outer extension portion, and shaped to be convex, and a second inclined surface extending from the second point to the outer end of the outer extension portion, and extending to be closer to the positive pressure surface as it becomes closer to the outer end of the outer extension portion, the second inclined surface being inclined relative to the positive pressure surface, wherein a first length in which the first inclined surface extends from the positive pressure surface to the first point is longer than a second length in which the second inclined surface extends from the second point to the outer end of the outer extension portion, and wherein the first flow guide protrusion is spaced in the axial direction from the air suction port and positioned outside a periphery of the air suction port.

15. The air conditioner of claim 14, wherein each of the plurality of blades comprises:

a second flow guide protrusion arranged, in a portion corresponding to the air suction port, on the positive pressure surface of the inner insertion portion, the second flow guide protrusion extending from one side to the other side of the inner insertion portion in the axial direction.

16. The air conditioner of claim 15, wherein the second flow guide protrusion is configured as a convex round surface, and wherein the second flow guide protrusion is arranged in a portion spaced from an inner end of the inner insertion portion in a longitudinal direction of the blade.

17. The air conditioner of claim 15, wherein the second flow guide protrusion includes a plurality of second flow guide protrusions being spaced apart from each other along a longitudinal direction of the blade.

18. The air conditioner of claim 14, wherein each of the plurality of blades comprises:

an edge inclined surface included in the positive pressure surface of the inner insertion portion, and arranged, in a portion corresponding to the air suction port, along one side of the inner insertion portion close to the shroud.

* * * * *